United States Patent [19]

Rossi et al.

[11] Patent Number: 4,994,730

[45] Date of Patent: Feb. 19, 1991

[54] CURRENT SOURCE CIRCUIT WITH COMPLEMENTARY CURRENT MIRRORS

[75] Inventors: Domenico Rossi, Cilavegna; Ermes Viani, Casalgrande; Guido Torelli, S. Alessio; Franco Maloberti, Torre D'Isola; Carla Vacchi, Pavia, all of Italy

[73] Assignee: SGS-Thomson Microelectronics S.r.l., Agrate Brianza, Italy

[21] Appl. No.: 448,498

[22] Filed: Dec. 11, 1989

[30] Foreign Application Priority Data

Dec. 16, 1988 [IT] Italy ..... 22964 A/88

[51] Int. Cl.[5] ..... G05F 3/20

[52] U.S. Cl. ..... 323/316; 323/315

[58] Field of Search ..... 323/315, 316

[56] References Cited

U.S. PATENT DOCUMENTS

| | | | |
|---|---|---|---|
| 4,323,797 | 4/1982 | Embree et al. | 323/316 |
| 4,325,019 | 4/1982 | Tezuka | 323/315 |
| 4,525,682 | 6/1985 | Lai et al. | 323/315 |
| 4,544,878 | 10/1985 | Beale et al. | 323/315 |
| 4,618,816 | 10/1986 | Monticelli | 323/316 |
| 4,706,013 | 11/1987 | Kuo | 323/316 |
| 4,716,358 | 12/1987 | Fucito | 323/316 |
| 4,717,869 | 1/1988 | Koch et al. | 323/316 |
| 4,740,743 | 4/1988 | Reisinger et al. | 323/316 |
| 4,853,609 | 8/1989 | Numata et al. | 323/315 |

*Primary Examiner*—Steven L. Stephan
*Assistant Examiner*—Jeffrey Sterrett
*Attorney, Agent, or Firm*—Guido Modiano; Albert Josif

[57] ABSTRACT

A current source circuit capable of generating two currents of opposite polarities. In order to generate the two currents, the circuit comprises a current source stage including a current mirror and feeding a first output current and an inverter stage connected to the source stage and generating a second output current with opposite polarity with respect to the first. The inverter stage comprises a current mirror and a variable current source defining a control electrode. In order to eliminate the differences in the amplitude of the output currents, the inverter stage comprises a memory element connected to the control electrode so as to store an electrode controlling signal. Switch elements are furthermore interposed between the first output and the second output so as to short-circuit them during the trimming step so that the two output currents are equal to one another while the memory element memorizes the control signal. This signal remains stored during the normal operation of the circuit.

6 Claims, 1 Drawing Sheet

CURRENT SOURCE CIRCUIT WITH COMPLEMENTARY CURRENT MIRRORS

BACKGROUND OF THE INVENTION

The present invention relates to a current source circuit with complementary current mirrors In particular, the invention relates to a circuit comprising N- and P-channel MOS devices.

As is known, given a reference current $I_{REF}$ with a given polarity, in some applications (such as analog to digital conversion) the current with opposite polarity is also required. Naturally, for reasons of accuracy and precision, the opposite-polarity current must be as similar as possible in amplitude to the reference current.

In order to obtain two currents with opposite polarity the use of a circuit such as for example the one illustrated in FIG. 1 is known; said circuit comprises a current mirror formed by the diode-connected transistor Ml and by the transistor M2. In said circuit, given the current $I_1$, said current is supplied at the output after being mirrored by the transistors M1 and M2 with an error which essentially depends on the offset or mismatching of the two transistors.

In order to obtain two output currents with identical amplitude and opposite polarity it is also possible to consider the use of a circuit such as the one illustrated in FIG. 2. Said circuit comprises, besides a current source 1 which supplies the current $I_{REF}$, a current source stage constituted by the transistors M3, M4 and M5, whereof M3 is diode-connected. The drain electrode of M5 constitutes the first output, which feeds the current $I_{OUT1}$, while the drain electrode of M4 is connected to an inverter stage, which comprises a pair of transistors M6 and M7 which are also connected so as to define a current mirror; a fixed resistor R and a variable resistor $R_T$ are respectively connected to the source electrodes of said transistors M6 and M7. The drain electrode of M7 defines the second output of the circuit, which feeds the current $I_{OUT2}$ which has an amplitude approximately equal to that of $I_{OUT1}$ and opposite polarity. In order to eliminate the differences in amplitude between the two output currents, in this circuit, during trimming, it is possible to measure said two output currents and modify the value of the resistor $R_T$ according to the difference between said two currents.

A solution of this kind, which eliminates the difference between the two output currents during trimming, does not ensure sufficient accuracy with regard to aging. If the circuit operates at a temperature which differs from the trimming temperature, differences may furthermore arise between the output currents. Finally, one should not neglect the fact that the circuit illustrated in FIG. 2 is disadvantageous due to the need to provide external devices or components capable of controlling the output currents and of modifying the value of the variable resistor (in particular, expensive laser trimming or pad trimming methods are required which entail considerable bulk). The additional cost of the trimming itself is also not negligible.

SUMMARY OF THE INVENTION

Given this situation, the aim of the present invention is to provide a current source circuit which is capable of providing two output currents with opposite polarities and equal amplitudes which operates with adequate accuracy and precision.

Within the scope of this aim, a particular object of the present invention is to provide a circuit of the indicated type which does not require external components for trimming but has a dynamic system for eliminating offset.

Another object of the present invention is to provide a circuit of the indicated type which has reduced bulk.

Not least object of the present invention is to provide a circuit of the above described type which operates reliably and is capable of ensuring the required accuracy even in the course of time and in variable conditions of temperature.

This aim, these objects and others which will become apparent hereinafter are achieved by a current source circuit with complementary current mirrors, as defined in the accompanying claims.

BRIEF DESCRIPTION OF THE DRAWINGS

The characteristics and advantages of the invention will become apparent from the description of a preferred but not exclusive embodiment, illustrated only by way of non-limitative example in the accompanying drawings, wherein.

DESCRIPTION OF THE PREFERRED EMBODIMENTS

Figure 1:
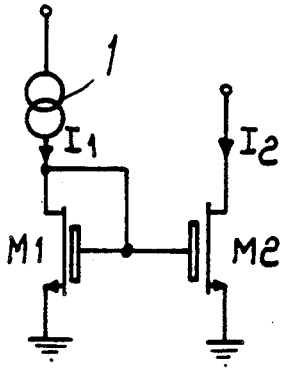
Fig. 1 PRIOR ART
FIG. 1 is a simplified diagram of a known current source circuit.
Figure 2:
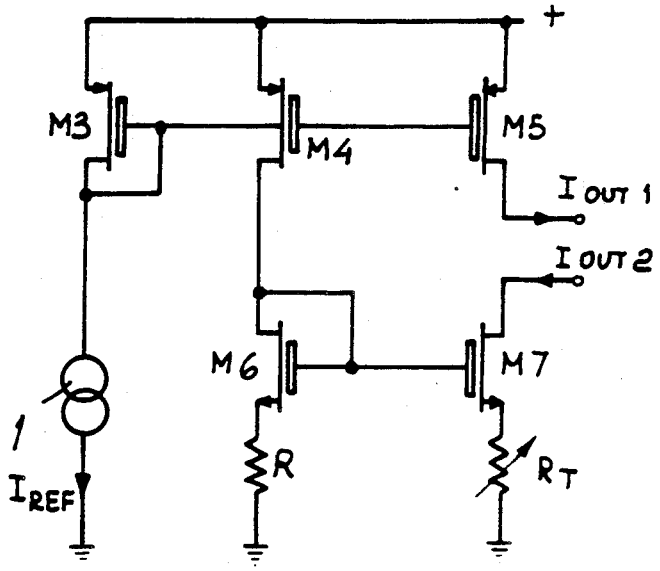
FIG. 2 is a circuit diagram of a possible solution.
Figure 3:
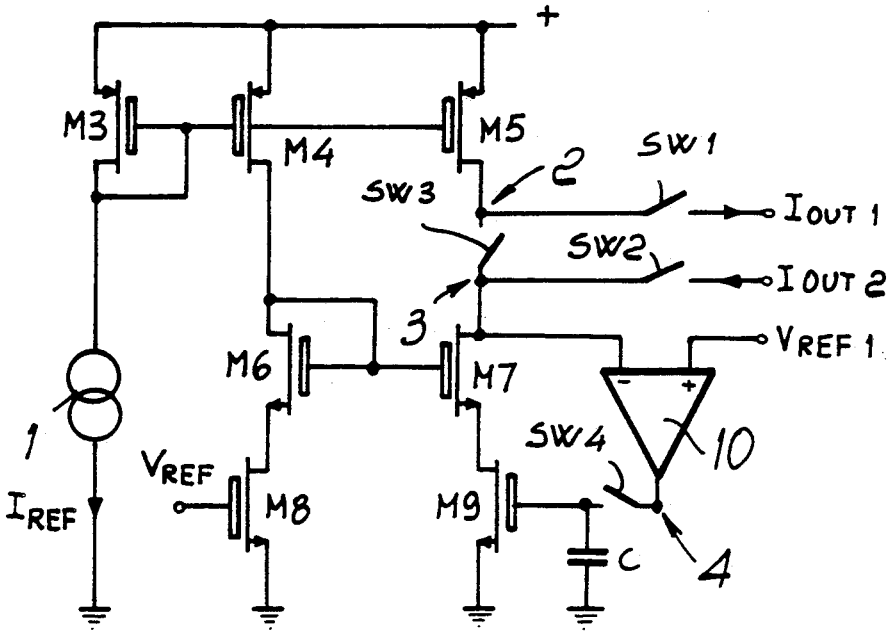
FIG. 3 is a simplified electric diagram of the current source circuit according to the invention.

Only FIG. 3 is described hereinafter; reference is made to the above description as regards FIGS. 1 and 2.

In the circuit according to the invention of FIG. 3, the elements in common with the solution of FIG. 2 have been given the same reference numerals in order to highlight the gist of the invention.

As in the diagram of FIG. 2, the circuit according to the invention therefore comprises a current source stage, including the MOS-type transistors M3, M4 and M5 and adapted to generate a first output current $I_{OUT1}$, and an inverter stage which is connected to the source stage and defines a second output which feeds a current $I_{OUT2}$ with opposite polarity with respect to the first. According to the invention, said inverter stage furthermore comprises, besides the MOS transistors M6 and M7, another pair of MOS transistors M8 and M9. In detail, the drain of M8 is connected to the source electrode of M6, its gate electrode is connected to a fixed reference voltage $V_{REF1}$ and its source electrode is connected to the ground, while the drain electrode of M9 is connected to the source electrode of M7, its source is also connected to the ground, and its gate electrode is connected to a capacitor C and to the drain electrode of the transistors M7 through a switch SW4 and an operational amplifier 10.

According to the invention, three other switches are furthermore provided: more specifically, the switch SW1, which is connected between the drain electrode of M5 and the first output, the switch SW2, which is connected between the drain electrode of M7 and the second output, and the third switch SW3, which is connected between the drain electrodes of M5 and M7. The operational amplifier is furthermore connected, with its non-inverting input, to a reference voltage $V_{REF1}$.

In order to clarify the operation of the circuit of FIG. 3, the presence of the operational amplifier 10 is initially ignored, and the point 4 is assumed to be connected directly to the drain of M7.

In the illustrated circuit, the transistors M8 and M9 operate in their triode region and therefore behave as two source degeneration resistors respectively with fixed and variable values, thus defining a fixed and a variable current sources. The trimming step is considered initially. In this step, the switches SW1 and SW2 are open and the switches SW3 and SW4 are closed. In this condition, the nodes 2, 3 and 4 are mutually short-circuited (if, as mentioned, the amplifier 10 is ignored) and their potential moves so as to charge the capacitor C at the voltage which modulates the resistor constituted by M9 so as to force a drain current of M5 to be equal to the drain current of M7. At equilibrium, the capacitor C is therefore charged at the voltage which causes the output currents of the source stage and of the inverter stage, which are supplied respectively by M5 and by M7, to be equal.

During the normal operation of the circuit, when the output currents are supplied to a load, the switches SW1 and SW2 are closed, while the switches SW3 and SW4 are opened. During this step, the capacitor C is disconnected from every low-impedance node and therefore stores the information regarding the control signal of the transistor M9 which preserves the equivalence between the two output currents until the successive trimming operation.

During the trimming step, the voltage of the two short-circuited nodes 2 and 3 assumes such a value as to eliminate the offset. Said value may be different from that of the operating voltage at which the drain electrodes of M7 and M5 actually operate.

The introduction of the operational amplifier 10, with its non-inverting input connected to a voltage $V_{REF1}$ which corresponds to the operating voltage, allows improved precision, since it avoids possible modulations of the current due to differences between the actual operating voltage and the trimming voltage, but does not modify the mode of operation and of offset elimination.

As can be seen from the above description, the invention fully achieves the proposed aim and objects. A current source circuit has in fact been provided which is capable of providing two output currents with opposite polarity and equal value without requiring any external components or complicated trimming operations. The described solution can furthermore be produced in a completely monolithic form by virtue of the possibility and ease of implementing the switches with CMOS technology. The method is furthermore self-calibrating, and since it is dynamic in real time it eliminates the offset and overcomes aging problems and temperature drifts.

The invention thus conceived is susceptible to numerous modifications and variations, all of which are within the scope of the inventive concept. In particular, the fact is stressed that though a complete diagram with the operational amplifier has been illustrated in FIG. 3, if such accurate precisions are not required said amplifier may be omitted.

All the details may furthermore be replaced with other technically equivalent elements.

We claim:

1. A current source circuit comprising a current source stage defining a first output and generating a first output current and an inverter stage connected to said source stage and defining a second output, said inverted stage generating a second output current with opposite polarity with respect to said first output current, said inverter stage comprising a variable current source defining a control electrode and a memory element connected to said control electrode and adapted to store a control signal for said variable current source, said current source circuit further comprising switch means interposed between said first and second outputs, said switch means being closed during a trimming step of said current source circuit, causing said first and second outputs to be short-circuited, said control signal to assume a value corresponding to an amplitude equivalence of said first and second output currents and said memory element to store said value of said control signal.

2. A circuit according to claim 1, wherein said variable current source comprises a MOS transistor having a gate electrode connected to said memory element.

3. A circuit according to claim 1, wherein said memory element comprises a capacitor.

4. A circuit according to claim 1, wherein said switch means comprise a first switch interposed between said first output of said current source stage and said second output of said inverter stage, said circuit further comprising a second switch interposed between said second output and said memory element.

5. A circuit according to claim 4, further comprising a third switch interposed between said current source stage and said first output and a fourth switch interposed between said inverter stage and said second output.

6. A circuit according to claim 4, further comprising an operational amplifier interposed between said second output and said second switch, said operational amplifier having an inverting input connected to said second output, a non-inverting input connected to a reference voltage and an output connected to said second switch.

* * * * *